US008235682B2

(12) United States Patent
Meitinger et al.

(10) Patent No.: US 8,235,682 B2
(45) Date of Patent: Aug. 7, 2012

(54) PUMP INCLUDING AN INSERTION VALVE SLEEVE HAVING AT LEAST ONE ORIFICE

(75) Inventors: Markus Meitinger, Eppstein (DE); Bernd Brunsch, Dreieich (DE)

(73) Assignee: ixetic Bad Homburg GmbH, Bad Homburg (DE)

( * ) Notice: Subject to any disclaimer, the term of this patent is extended or adjusted under 35 U.S.C. 154(b) by 843 days.

(21) Appl. No.: 12/308,777

(22) PCT Filed: Jun. 12, 2007

(86) PCT No.: PCT/DE2007/001020

§ 371 (c)(1),
(2), (4) Date: Dec. 23, 2008

(87) PCT Pub. No.: WO2007/147382

PCT Pub. Date: Dec. 27, 2007

(65) Prior Publication Data

US 2009/0301586 A1 Dec. 10, 2009

(30) Foreign Application Priority Data

Jun. 24, 2006 (DE) ..... 10 2006 029 165

(51) Int. Cl.
*E03B 11/16* (2006.01)
*F16K 3/00* (2006.01)

(52) U.S. Cl. ..... 417/279; 417/310; 417/291; 417/440; 417/441

(58) Field of Classification Search ..... 417/310, 417/295, 298, 440, 441, 279
See application file for complete search history.

(56) References Cited

U.S. PATENT DOCUMENTS

| | | | | |
|---|---|---|---|---|
| 3,614,266 | A | 10/1971 | Ciampa et al. | |
| 4,276,812 | A * | 7/1981 | Dymond | 91/467 |
| 4,483,365 | A * | 11/1984 | Fallon | 137/343 |
| 5,378,118 | A | 1/1995 | Phillips | |
| 6,406,278 | B1 * | 6/2002 | De Matthaeis et al. | 417/454 |
| 2005/0019175 | A1 | 1/2005 | Uchino et al. | |
| 2007/0251579 | A1 * | 11/2007 | Weide | 137/375 |

FOREIGN PATENT DOCUMENTS

| | | |
|---|---|---|
| DE | 4 428 667 | 2/1995 |
| JP | 2001 263270 | 9/2001 |

* cited by examiner

*Primary Examiner* — Anne Hines
*Assistant Examiner* — Tracie Y Green
(74) *Attorney, Agent, or Firm* — Davidson, Davidson & Kappel, LLC

(57) ABSTRACT

Pump, in particular a servo steering pump for motor vehicles, having a flow control valve and a valve sleeve which has inflow openings to the flow control valve and a pressure connection to a hydraulic load.

20 Claims, 2 Drawing Sheets

PUMP INCLUDING AN INSERTION VALVE SLEEVE HAVING AT LEAST ONE ORIFICE

The present invention relates to a pump, in particular to a power-steering pump for motor vehicles, having a flow-control valve and a valve sleeve which has inflow orifices leading to the flow-control valve and a pressure connection to a hydraulic load.

BACKGROUND

Pumps of this kind are generally known. In this context, the valve sleeves have a screw-fastened type pressure connection which is screwed into a thread of the pump housing. However, numerous disadvantages are associated with screw-in valve sleeves.

SUMMARY OF THE INVENTION

It is an object of the present invention to devise a pump which will overcome the disadvantages of the known valve sleeves.

The present invention provides a pump, in particular a power-steering pump for motor vehicles, having a flow-control valve and a valve sleeve which has inflow orifices leading to the flow-control valve and/or a through-orifice for a throttling point and a pressure connection to a hydraulic load, the valve sleeve being designed as an insertion sleeve and being axially positioned in the pump housing by a securing device.

By designing the valve sleeve as an insertion sleeve, the benefit is derived that the insertion sleeve is able to be inserted into the pump housing at a precise angular orientation. Moreover, there are no screw-in forces acting on the thread which would have a deforming effect on the valve sleeve or the pump housing.

One preferred exemplary embodiment of the pump provides for the valve sleeve to have at least one transverse bore that is positioned relative to an outflow bore in the pump housing. Thus, the design of the insertion sleeve makes it possible to use just one single transverse bore since the insertion sleeve is able to be positioned relative to the housing during installation. Therefore, there may be no need for a plurality of transverse bores, as is the case when working with a screw-in sleeve, thereby making it possible to provide an adequate flow cross section to the outflow bore.

Another preferred embodiment provides a pump where a pressure line is configured so as to be insertable into the pressure-connection side of the valve sleeve. It is also conceivable, however, that the pressure line may be screwed into the valve sleeve.

A pump is also preferred where the securing device is in the form of a flange that is attached to the pressure line. Here the advantage may be derived that the pressure line is also able to be installed at a precise angular orientation since the flange predetermines the direction of the pressure line, thereby making it possible to observe predefined positions in the engine compartment of a motor vehicle.

A distinguishing feature of the pump according to the present invention is that the flange is welded or soldered to the pressure line, or pressed in place or screwed into position on the same.

Another embodiment of the present invention provides a pump with a distinguishing feature that the flange has a plane mounting surface. A pump is also preferred where the flange has an angled mounting surface. Here the advantage may be derived that it is possible to vary the location specified for an attachment means for the flange on the housing.

A pump is also preferred where the flange-mounting surface may be secured to the pump housing by at least one screw. Thus, once the screw is tightened, both the hydraulic line, as well as the valve insertion sleeve are fastened and secured in the axial direction of the valve insertion sleeve.

Another pump according to the present invention has the distinguishing feature that the securing device may be constituted of a flange that is fixed into place within the pump housing by interlocking deformation. This eliminates the need for an additional attachment means, such as a screw, for example, thereby achieving a very space-saving, axial securing of the valve sleeve.

Another advantage of the insertion sleeve is that it may be inserted centrically relative to the valve piston, particularly when the insertion sleeve has a funnel-shaped valve seat for the valve piston, whereas a screw-in cartridge can lead to a widening of the valve bore in the housing and to a misalignment between the valve piston and the valve seat due to a potential offset between the thread and the funnel-shaped valve seat.

BRIEF DESCRIPTION OF THE DRAWINGS

The present invention is described below in greater detail with reference to the figures, which show.

DETAILED DESCRIPTION

Figure 1:
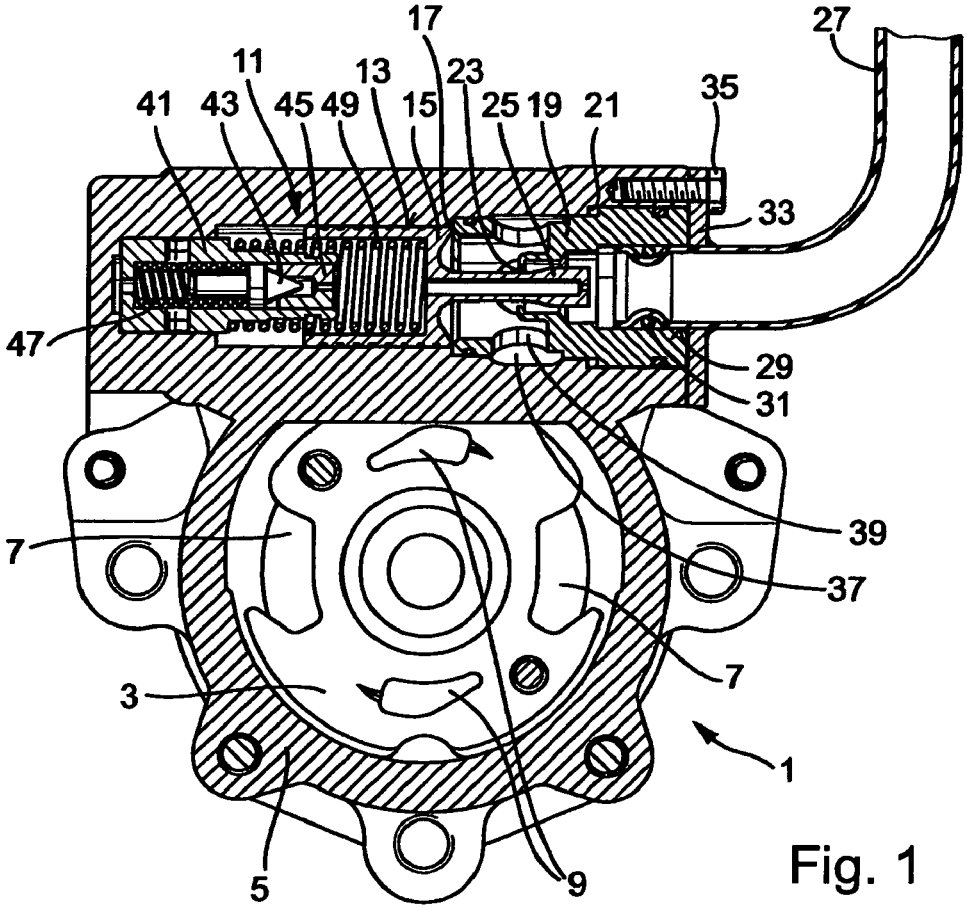
FIG. 1 a cross section through a power-steering pump having an insertion sleeve according to the present invention and a corresponding flange coupling at the pressure line.

A power-steering pump 1 having a pump rotation group and a valve assembly is shown in cross section in FIG. 1. Of the rotation group, what is generally referred to as a control plate 3 is discernible within pump housing 5, control plate 3 including kidney-shaped suction ports 7 and kidney-shaped pressure ports 9 for a two-stroke vane pump. The rotor and the vane of the vane pump are not shown here. Illustrated in the upper portion of pump housing 5 is a valve assembly 11 which is capable of performing the combination function of a flow-control valve and of a pilot-controlled pressure-limiting valve. A valve piston 15 is displaceably mounted in a valve bore 13 of pump housing 5. Valve piston 15 rests by a sealing edge 17 against an approximately funnel-shaped seat of a valve sleeve 19. Valve sleeve 19, in turn, is insertably mounted within a widened portion 21 of valve bore 13. In addition, valve sleeve 19 has a through-orifice 23 in which a partially conical stem 25 of valve piston 15, together with through-orifice 23, forms a variable throttling point for the oil flow to the load. The load oil flow is supplied through pressure line 27 to the load, for example a hydraulic servo steering. Pressure line 27 is inserted in region 29 of valve sleeve 19 and is additionally provided with a seal 31. In addition, pressure line 27 has a flange 33 which, in this case, is attached by a weld joint to pressure line 27 and is secured by a screw 35 in housing 5. An outflow bore 37 leads from the pressure region of the vane pump into the valve region where a corresponding inflow orifice 39 of valve sleeve 19 is configured to oppose outflow bore 37 in the housing. Due to the fact that valve sleeve 19 may be positioned as an insertion sleeve oppositely to outflow bore 37 in housing 5, a clearly defined transitional cross section is always obtained between outflow bore 37 and valve sleeve 19. This is not possible using related-art screw-in sleeves because, depending on the thread and the screw-down force, the screw-in action results in a difference between the corresponding positions of inflow orifices 39. The valve assembly in the upper portion of housing 5 also has a pressure-limiting pilot valve having a pilot valve sleeve 41 in which a pilot valve cone 43 is sealingly supported in a valve seat 45 and is pressed by a spring 47 into the valve seat. In response to the pretensioning force of spring 47 exceeding the adjustable maximum pressure, valve cone 43 opens by lifting off from seat 45, and, together with valve piston 15, thereby provides a pilot-controlled pressure-limiting valve. For as long as the maximum pressure is not exceeded, valve piston 15, which is pressed by a spring 49 into sealing edge 17, functions as a flow-control valve piston and limits the volumetric flow flowing out toward the load to a specific value. Flow-control valve and pressure-limiting valve functions of this kind are sufficiently known from the related art and, therefore, do not require further clarification here.

Worth mentioning in this case is that the present invention makes it possible for insertion sleeve 19 to be positioned relative to outflow bore 37, so that, as the case may be, it requires only one single inflow orifice 39, while the related art requires using a plurality of inflow orifices as outflow bores in order to realize the requisite hydraulic orifice cross sections. In addition, there are no screw-in forces acting on valve sleeve 19 or, therefore, on positioning bore 21. Under the related art, these such screw-in forces can lead to deformations and decentering. A further advantage is provided by pressure line 27 having welded-on flange 33 which may be mounted in the corresponding requisite installation position for optional placement in the engine compartment of a motor vehicle. A positionally correct installation is thus made possible without the need for subjecting the pressure line to screw-in movements. Both pressure line 27, as well as valve sleeve 19 are axially fixed into place at the pump housing by separate screw 35 between flange 33 and pump housing 5.

Figure 2:
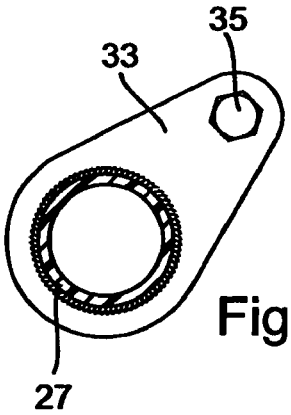
FIG. 2 a plan view of the flange coupling.

A plan view of flange 33 of FIG. 1 is shown exemplarily in FIG. 2. Pressure line 27, which is shown in a sectional view, is attached by weld joint to flange 33. One single screw 35 is used to affix flange 33 in the illustrated position to the pump housing. Thus, the position of flange 33 relative to the configuration of pressure line 27, as shown in FIG. 1, is fixed for the installation in the motor vehicle.

Figure 3:
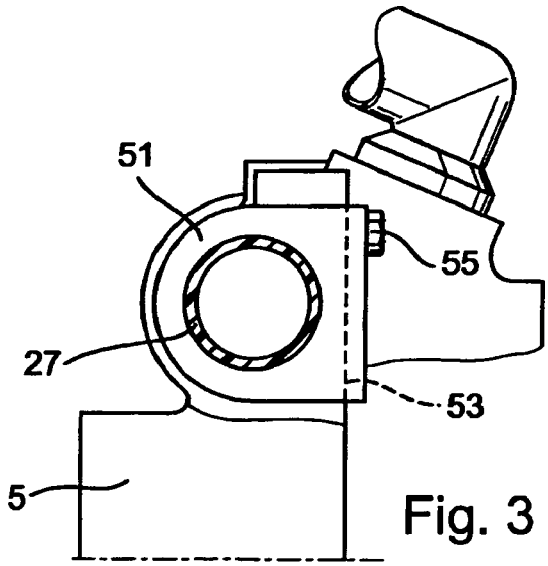
FIG. 3 an angled flange coupling at a pump housing.

Alternatively, FIG. 3 shows a flange 51 having an angled mounting surface 53. This makes it possible for a different surface of housing 5 to be used as the connection surface for pressure line 27 for the mounting attachment in the case that the intake plane of pressure line 27 does not have any available space for a screw 55, and housing 5 does not have a corresponding thread.

Figure 4A:
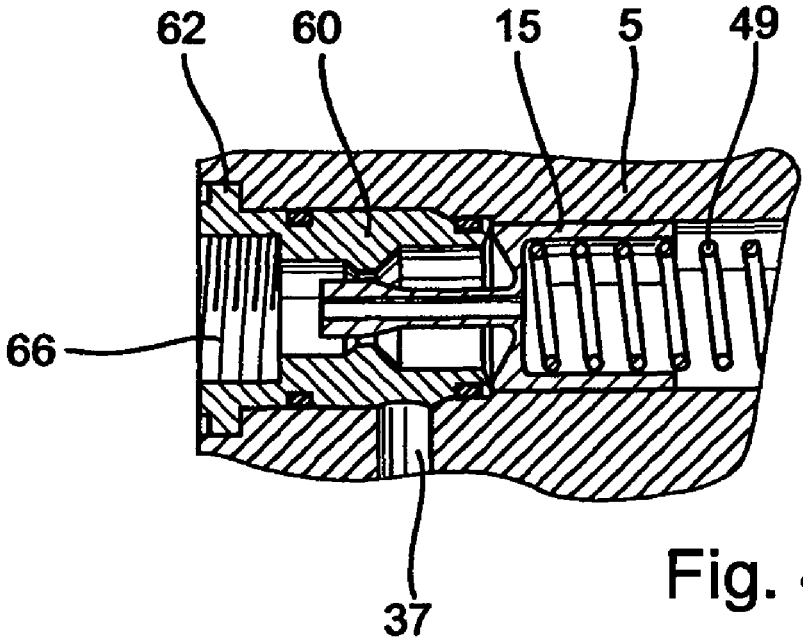
FIGS. 4*a* and 4*b* a valve sleeve having a flange that is fixed into place within the pump housing by interlocking deformation.
Figure 4B:
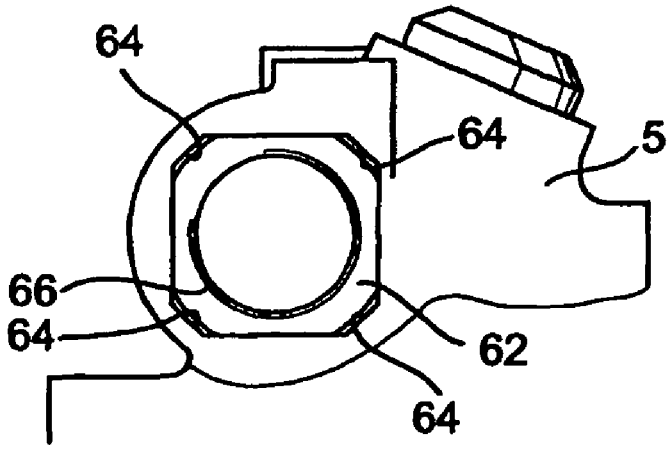

Another variant of a valve insertion sleeve 60 is shown in FIGS. 4*a* and 4*b*. In this case, valve insertion sleeve 60 has a flange 62 which, in FIG. 4*b*, is fixed into place within housing 5 by four interlocking deformation points 64. Here as well, it is possible to suitably position the inflow orifices of valve sleeve 60 and of housing 5, respectively outflow bore 37 relative to each other. Also illustrated in FIG. 4*a* are flow-control valve piston 15 and corresponding spring 49 which presses valve piston 15 against valve sleeve 60. Alternatively to an insertion pressure line, in this case, a screw-in pressure line may also be screwed into an internal thread 66 of valve sleeve 60. However, the pressure line could be equally used as an insertion pressure line, in the manner of pressure line 27 illustrated in FIG. 1.

LIST OF REFERENCE NUMERALS

1 power-steering pump
3 control plate
5 pump housing
7 kidney-shaped suction ports
9 kidney-shaped pressure ports
11 valve assembly
13 valve bore of pump housing 5
15 valve piston
17 sealing edge
19 valve sleeve
21 widened portion of valve bore 13
23 through-orifice
25 conical stem of valve piston 15
27 pressure line
29 region of valve sleeve 19 for pressure line 27
31 seal
33 flange
35 screw
37 outflow bore
39 inflow orifice of valve sleeve 19
41 pilot valve sleeve
43 pilot valve cone
45 valve seat
47 spring
49 spring
51 flange
53 angled mounting surface
55 screw
60 valve insertion sleeve
62 flange
64 interlocking deformation point
66 internal thread of valve sleeve 60

The invention claimed is:

1. A pump comprising:

a pump housing including a valve bore and an outflow bore extending from the valve bore;

a flow-control valve in a first end of the valve bore; and a valve sleeve in second end of the valve bore having at least one inflow orifice leading to the flow-control valve-and/or to a through-orifice for a throttling point and a pressure connection to a hydraulic load, wherein the valve sleeve is an insertion sleeve and is axially positioned in the pump housing by a securing device, the securing device securing the valve sleeve such that the valve sleeve forces the flow-control valve against the first end of the valve bore.

2. The pump as recited in claim 1 wherein the pump is a power steering pump for a motor vehicle.

3. The pump as recited in claim 1 wherein the valve sleeve has at least one inflow orifice positioned relative to an outflow bore in the pump housing.

4. The pump as recited in claim 1 further comprising a pressure line configured to be coupled to the pressure connection side of the valve sleeve.

5. The pump as recited in claim 1 wherein the securing device is a flange-attached to the pressure line.

6. The pump as recited in claim 1 wherein the flange is rigidly affixed to the pressure line.

7. The pump as recited in claim 5 wherein the flange has a plane mounting surface.

8. The pump as recited in claim 5 wherein the flange has an angled mounting surface.

9. The pump as recited in claim 7 wherein the mounting surface of the flange is secured to the pump housing by at least one screw.

10. The pump as recited in claim 1 wherein the securing device a flange fixed into place within the pump housing by interlocking deformation.

11. The pump as recited in claim 6 wherein the flange is rigidly affixed to the pressure line by welding.

12. The pump as recited in claim 6 wherein the flange is rigidly affixed by soldering.

13. The pump as recited in claim 6 wherein the flange is rigidly affixed by being pressed in place.

14. The pump as recited in claim 6 wherein the flange is rigidly affixed by being screwed.

15. The pump as recited in claim 1 further comprising a pressure line inserted into the valve sleeve for providing fluid through the valve sleeve to the flow-control valve.

16. The pump as recited in claim 15 wherein the securing device secures the line in the valve sleeve.

17. The pump as recited in claim 1 wherein the flow-control valve includes a valve piston extending away from the first end of the valve bore towards the valve sleeve.

18. The pump as recited in claim 1 wherein the flow-control valve includes at least one spring.

19. The pump as recited in claim 1 wherein the valve sleeve includes an inner through orifice configured for fluid to flow axially through towards the flow-control valve.

20. The pump as recited in claim 1 wherein a first end of the flow-control valves contacts the first end of the valve bore and a second end of the flow-control valve contacts the valve sleeve.

* * * * *